US005184774A

United States Patent [19]

Lipson

[11] Patent Number: 5,184,774

[45] Date of Patent: Feb. 9, 1993

[54] DRINKING STRAW ASSEMBLY KIT

[76] Inventor: Eric Lipson, 213 S. Bonsall St., Philadelphia, Pa. 19103

[21] Appl. No.: 699,191

[22] Filed: May 13, 1991

[51] Int. Cl.[5] ..... A47G 21/18

[52] U.S. Cl. ..... 239/33

[58] Field of Search ..... 239/33

[56] References Cited

U.S. PATENT DOCUMENTS

| | | | |
|---|---|---|---|
| 2,063,803 | 12/1936 | Gildersleeve | 239/33 |
| 2,557,411 | 6/1951 | Butsch | 239/33 |
| 2,619,770 | 12/1952 | DinHofer | 239/33 |
| 3,260,462 | 7/1966 | Smaczny | 239/33 |
| 3,326,695 | 6/1967 | Neuhauser | 239/33 |
| 3,425,626 | 2/1969 | Dietz et al. | 239/33 |
| 3,517,884 | 6/1970 | Horvath | 239/33 |
| 3,606,156 | 9/1971 | Homorodean, Jr. et al. | 239/33 |
| 3,773,256 | 11/1973 | Wright | 239/33 |
| 3,957,202 | 5/1976 | Hornsby, Jr. | 239/33 |
| 4,374,596 | 2/1983 | Schlemmer et al. | 285/305 |
| 4,699,319 | 10/1987 | Green | 239/33 |

FOREIGN PATENT DOCUMENTS

| | | | |
|---|---|---|---|
| 284735 | 10/1988 | European Pat. Off. | 239/33 |
| 3407733 | 9/1985 | Fed. Rep. of Germany | 239/33 |
| 2032756 | 5/1980 | United Kingdom | 239/33 |

*Primary Examiner*—Andres Kashnikow
*Assistant Examiner*—Lesley D. Morris
*Attorney, Agent, or Firm*—Krass & Young

[57] ABSTRACT

A drinking straw assembly includes a plurality of drinking straw tubular segments with each segment having a first open end and a second open end with a tubular passage therebetween. A tubular fastener is permanently attached to the second end of each of the tubular segments and is removably connectable to the first open end of another one of the tubular segments. A mouthpiece is connectable to one of the tubular fasteners. A plurality of the tubular segments have different shaped convolutions, twists and windings such that an assembly of the tubular segments provide for a serpentine convoluted drinking straw assembly.

7 Claims, 2 Drawing Sheets

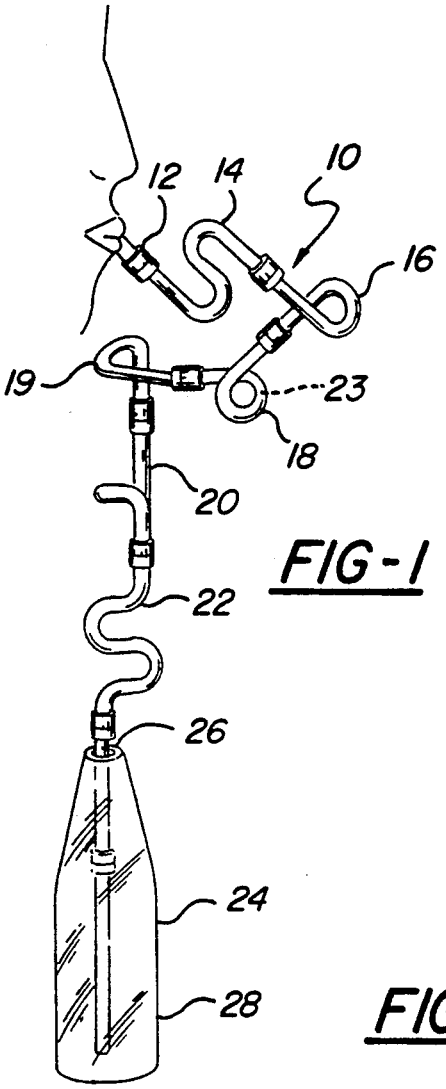
FIG-1
FIG-2
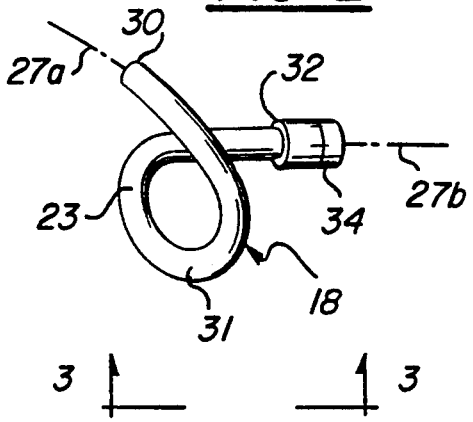
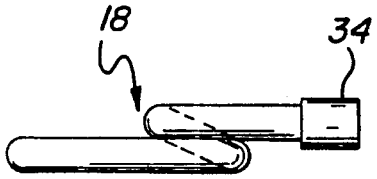
FIG-3
FIG-4
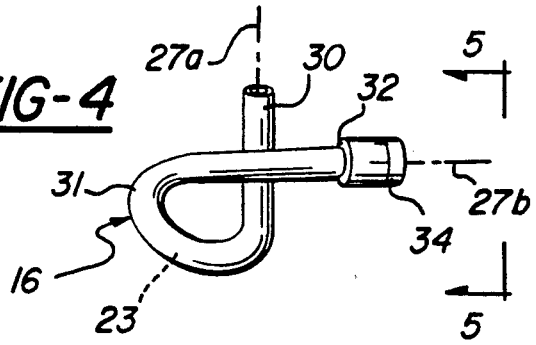
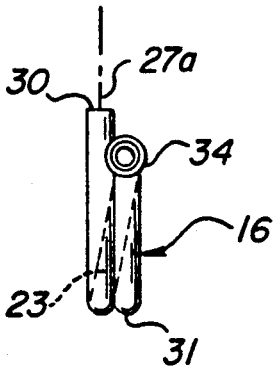
FIG-5
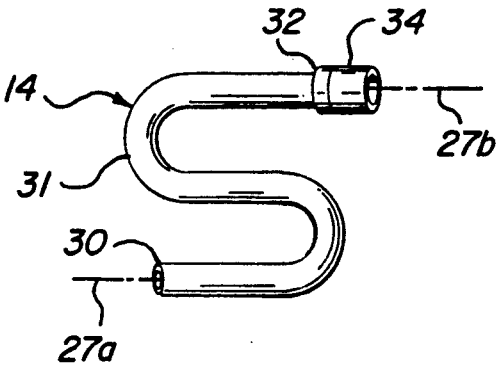
FIG-6

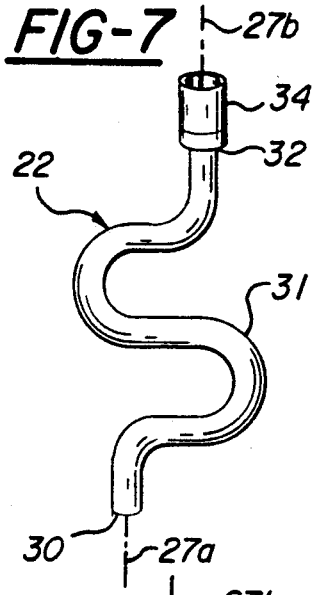
FIG-7
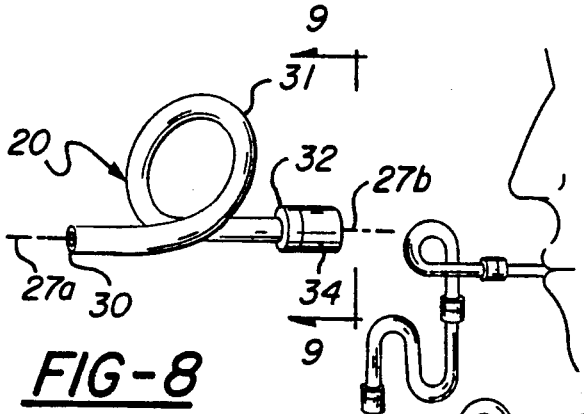
FIG-8
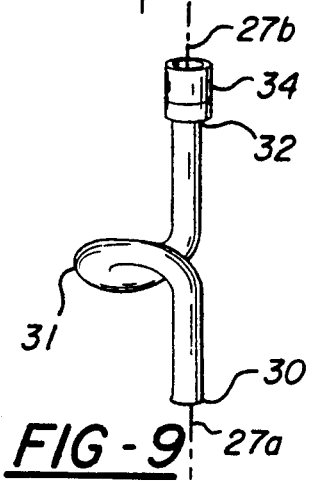
FIG-9
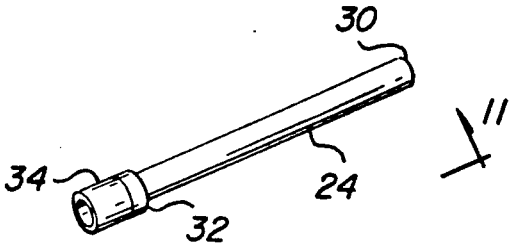
FIG-10
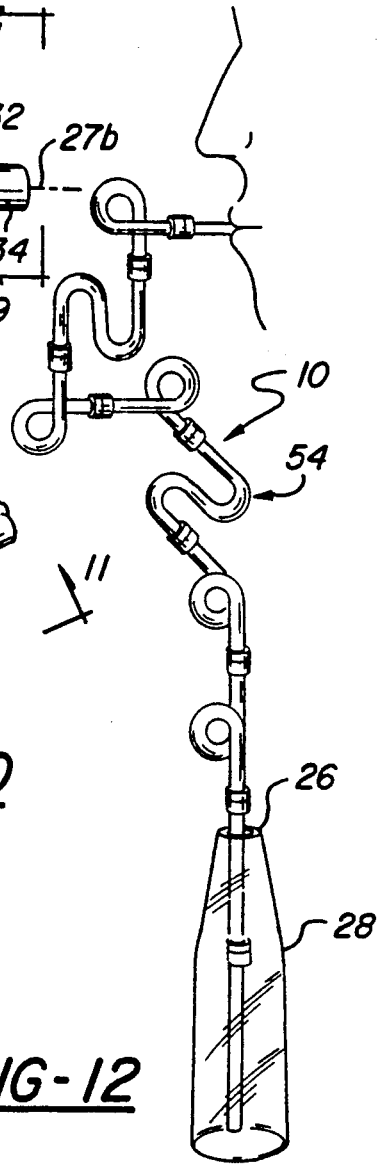
FIG-12
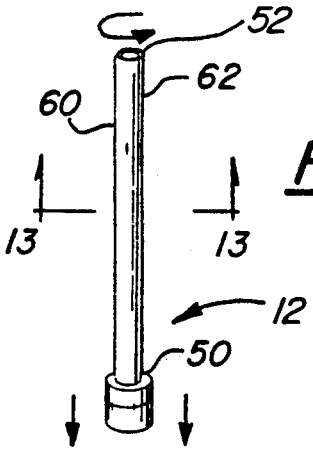
FIG-11
FIG-13
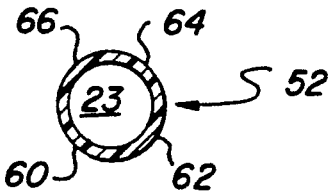

DRINKING STRAW ASSEMBLY KIT

TECHNICAL FIELD

This invention relates to drinking straws and more particularly to a novelty drinking straw that can be assembled together and change colors.

BACKGROUND OF THE INVENTION

Drinking straws have long been used to withdraw liquids from a narrow neck container or from other jars and glasses. Straws have commonly been made from paper and flexible plastic. Straws have been constructed with corrugated walls to promote flexing of the straw without crimping of the central tubular passageway. Plastic straws have also been heat formed into various shapes such as eyewear spectacles to promote interest and amusement in the straw and drinks.

One novelty straw is disclosed in U.S. Pat. No. 3,260,462 to Smaczny on Jul. 12, 1966. The Smaczny patent discloses a mouthpiece connected to two bifurcated leg portions. The leg portions are connected to a forked connecting piece assembly having a swirl chamber therein. This straw is used to simultaneously suck liquids from two drinking containers.

The known novelty straws, while initially providing amusement, often quickly become routine and uninteresting because they are static and do not readily change shape to hold the interest and curiosity of a young child. What is needed is a drinking straw assembly kit having a plurality of tubular segments with different convolutions and twists that can allow the user to assemble the segments together to form various shapes of one own's design and creation. What is also needed in conjunction with a segmented straw assembly are straw segments that can change color.

SUMMARY OF THE INVENTION

In accordance with one aspect of the invention, a drinking straw assembly kit includes a plurality of tubular segments having first and second open ends with a passageway connecting the two ends. Some of the tubular segments have different convolutions, twists, bends and windings between the open ends. The twists, bends and convolutions can be in the form of letters or numerals such that the user can spell a word or create a number. The convolutions can also be in the form of helixes, spirals, coils, U-bends, 90° bends, and other various contours. The convolutions may be either planar or may extend in 3-dimensional space. Other thematic pictorial shapes can also be incorporated to each segment.

A portion of these tubular segments have their first open end approximately axially aligned with the second open end. A second portion of the tubular segments have their first open end substantially transverse or canted to their second open end and a portion of the tubular segments have their first open end substantially parallel to their second open end. It should be understood that when the direction of the openings are stated, it is the direction of the longitudinal central axis segment of the passageway at the first end relative to the central axis segment of the passageway at the second end that is being viewed. One tubular member has its second open end connectable to the first open end of another tubular member such that a drinking straw of a desired convoluted and contoured shape can be assembled from the plurality of tubular members.

Preferably a tubular fastener is permanently attached to the second open end of the tubular segments and is connectable to the first open end of another tubular segment. Preferably, the tubular fastener has an inner diameter sized to receive the open ends of the tubular segments and is made from clear transparent plastic that is flexible to conform to the shape of the tubular segment therein. The fastener inner diameter and tubular segment outer diameter are preferably circular to allow relative rotation of one tubular segment with respect to another. The user can then create more configurations by pivoting the tubular segments with respect to one another.

The plurality of tubular segments are preferably made from a semi-rigid plastic such as polyester and can be tinted various colors and have a transparent or translucent appearance. Alternately, the segments may be colored with heat sensitive materials that change color when a cold or warm liquid passes through the straw. Several color change materials can be extruded together to form stripes, or helixes of differing color bands, each one capable of changing color.

In one embodiment a separate mouthpiece is connectable to the second end of a tubular segment. The mouthpiece does not have a fastener at either end thereof such that its second end is open to allow someone to insert it in their mouth without any obstacles caused by a tubular connector element.

A portion of the tubular segments may be straight such that one can extend the assembled straw down through a narrow bottle or can opening.

According to another aspect of the invention, a drinking straw is made from temperature sensitive color change plastic material that changes color when one of a hot or cold drink passes therethrough. Several color change materials may take the form of longitudinal strips adjacent one another such that the straw may change to several colors simultaneously when a hot or cold drink passes therethrough.

In this fashion the tubular segments may be arranged and/or rearranged to form different shape drinking straws with a different arrangement of convolutions, twists, bends and color arrangement.

BRIEF DESCRIPTION OF THE DRAWINGS

Reference now is made to the drawings in which:

FIG. 1 is a view of one embodiment of a drinking straw assembly according to the invention;

FIG. 2 is an elevational view of one of the tubular segments showing a coil convolution;

FIG. 3 is a view taken along 3—3 in FIG. 2;

FIG. 4 is view of another tubular segment;

FIG. 5 is a view taken along the lines 5-5 of FIG. 4;

FIG. 6 is a view of a S-shaped tubular segment;

FIG. 7 is a view of another S-shaped tubular

FIG. 8 is a perspective view of another coiled tubular segment;

FIG. 9 is a view taken along line 9—9 of FIG. 8;

FIG. 10 is a view of a straight tubular segment;

FIG. 11 is a view of a mouthpiece connectable to another tubular segment;

FIG. 12 is a view of an alternate arrangement of the drinking straw assembly; and FIG. 13 is an enlarged cross-sectional view taken along lines 13—13 of FIG. 11.

DETAILED DESCRIPTION OF THE PREFERRED EMBODIMENTS

Referring now to FIG. 1, a drinking straw assembly 10 includes a mouthpiece 12 and a plurality of tubular segments 14–24. As shown in FIGS. 2–10, each of the tubular segments 14–22 have convolutions, twists or bends 31 between a first end 30 and second end 32 with an open passage 23 communicating therebetween. A tubular fastener 34 is permanently attached to the second end 32 of each of the tubular segments and is removably connectable to the first end 30 of the tubular segments. The tubular fastener 34 is made out of a flexible clear plastic such as vinyl which is flexible to adapt to the shape of the first and second ends. The tubular fastener 34 is permanently attached to the second end 32 via a solvent glue. Sonic welding can be an alternative way to bond the fastener to the second end.

Referring now to FIG. 2, a closer look at the tubular segment 18 can be shown. The tubular segment has its first end 30 angled with respect to the second end such that inlet is angled with respect to the outlet. It should be understood that when the first end is in a position relative to the second end, it is the central axis 27 of the passage at the first end 30 relative to the central axis 27 of the passage at the second end 32 that is being measured. The convolution 31 is in the form of a coil which is relatively coplanar with the opening as shown in FIG. 3.

FIG. 4 shows a tubular segment 16 that has its inlet first end 30 substantially perpendicular to the outlet second end 32. Again. the convolution 31 is in the form of a coil which is substantially planar with the inlet and outlet shown in FIG. 5.

FIG. 6 is a more detailed look of tubular segment 14 in which the first end 30 is substantially parallel to the second end 32. The convolution 31 is in the form of an S-curve.

FIG. 7 is a more detailed look at tubular segment 22 wherein the convolution 31 is in the form of another S-curve. Its first end 30 is slightly displaced radially with respect to its second end 32.

FIGS. 8 and 9 discloses a more detailed look at tubular segment 20. In this tubular segment, the convolution 31 is in the form of a coil which extends in a plane substantially transverse to the axis formed by the first end 30 and second end 32 which ar aligned.

FIG. 10 discloses a tubular segment 24 which is straight. Tubular segment 24 is particularly amenable to being inserted in narrow bottle openings 26 of bottle 28 as shown in FIG. 1. It could also be inserted into small openings of a can or a glass container. Since there are no convolutions on tubular segment 24, the first end 30 is aligned with second end 32.

FIG. 11 discloses the mouthpiece 12 which has a first end 50 and second end 52. Neither end 50 or 52 have a fastener permanently attached thereto. The mouthpiece can be insertable into a fastener 34 permanently attached to second end 32 of one of the other tubular segments. In this way a person may insert the mouthpiece 12 into his mouth as shown in FIG. 1. The mouthpiece 12 may be elongated and used alone as a one piece straw, particularly when it is made from temperature sensitive material as described in more detail below.

The tubular segments 14, 16, 18, 19, 20, 22, 23 and 24 can be made from a semi-rigid plastic such as polyester which can either be translucent, or transparent with various colored tints.

Alternatively, each segment can be made from commercially available heat sensitive color change plastic material. One such color change material is PSD-R. Each straw segment can be coextruded from the color change plastic material with different color pigments therein such that vertical or helical stripes 60, 62, 64, 66 are formed longitudinally along the straw segment and circumferentially spaced about the passage 23. The straw segment may appear to be white at room temperature but when a hot or cold drink passes through the straw, the material changes colors to show the different colored strips 60, 62, 64 and 66. For example, strips 60 and 64 may turn red and strips 62 and 66 may turn blue. It should be understood, red and blue are examples only and any combination of colors may be used.

Alternatively, each segment may be made from a different heat sensitive color change material that when the hot or cold drink passes through the straw, each segment may change to a different color.

In this fashion, an assembled drinking straw having a number of convolutions, twists and turns can be assembled. As shown in FIG. 12, the individual tubular segments can be disconnected and rearranged into a different arrangement 54.

Once assembled any tubular straw segment can be rotated with respect to any other straw segment due to the round shape of the tube and flexible connector 34. The rotation provided for more variety of shapes.

The tubular segments can be disassembled for ease in washing and cleaning and can be easily stored in a small box or bag. A person can arrange the tubular segments according to color or according to shape or arrange the tubular segments at random.

It should be understood that the convolutions between the first end and second end are not limited to the ones shown but can be shaped like U's, C's, helixes or any other random serpentine convolution. If desired, the straw segments can be formed into numerical or letter shapes or create thematic picture elements that can be assembled together. It should also be understood that while a tubular straw segment with a circular outer periphery is illustrated, the outer periphery between the two ends may have other cross-sectional shapes.

Other variations and modifications of the present invention are possible without departing from its scope and spirit as defined in the appended claims.

The embodiments in which an exclusive property or privilege is claimed are defined as followed:

1. A drinking kit for assembly and reassembly into a variety of configurations, said kit comprising:

a plurality of tubular drinking straws having first and second ends, at least some of said plurality of straws being nonlinear in configuration;

connecting means for connecting the first end of one of said plurality of straws to the second end of any other of said a tubular mouthpiece having a first end for removable connection to said connecting means and a second end free of any connection means for insertion into a user's mouth, so that said plurality of straws and mouthpiece can be assembled to form a drinking passage configuration selected by said user and reassembled to form a different drinking passage configuration as desired.

2. A drinking straw kit as defined in claim 1 further characterized by:

said connecting means includes a tubular fastener connectable to said second end of said one straw and to said first end of said any other straw such that said another straw is rotatable within said tubular fastener.

3. A drinking straw kit as defined in claim 2 further characterized by:

said tubular fastener having an inner diameter sized to slidably receive said straws therewithin, said first end of said straw being removably insertable in said tubular fastener.

4. A drinking straw as defined in claim 1 further characterized by:

a portion of said plurality of straws having their first end approximately axially aligned with their second end;

a portion of said plurality of straws having their first end oriented substantially transverse to their second end; and a portion of said plurality of straws having their first end oriented substantially parallel to their second end.

5. A drinking straw kit as defined in claim 1 further characterized by:

said connecting means being made from clear transparent plastic material; and said straws being made from tinted transparent plastic material.

6. A drinking straw kit as defined in claim 1 further characterized by:

said straws being made from a heat sensitive color change plastic material.

7. A drinking straw kit as defined in claim 6 further characterized by:

each of said straws having at least one area of heat sensitive color change plastic material, some of said areas changing to a different color from others of said areas such that said straws may be assembled into a configuration that changes into a plurality of color simultaneously when one of a hot and color liquid passes therethrough.

* * * * *

UNITED STATES PATENT AND TRADEMARK OFFICE

CERTIFICATE OF CORRECTION

PATENT NO. : 5,184,774

DATED : 02/09/93

INVENTOR(S) : Erik Lipson

It is certified that error appears in the above-identified patent and that said Letters Patent is hereby corrected as shown below:

On the title page, item [76]:
Inventor's name should read "Erik"

Column 2, Line 58, Delete "tubular" Insert --tubular segment;--

Column 3, Line 47, Delete "ar" Insert --are--

Column 4, Line 56, after "said" "plurality of straws, and" is missing

Signed and Sealed this

Ninth Day of November, 1993

Bruce Lehman

*Attest:*

BRUCE LEHMAN

*Attesting Officer*

*Commissioner of Patents and Trademarks*